US007229260B2

(12) United States Patent
Mach et al.

(10) Patent No.: US 7,229,260 B2
(45) Date of Patent: Jun. 12, 2007

(54) OILLESS AIR MOTOR ASSEMBLY FOR HYDRAULIC PUMPS

(75) Inventors: Oai Tuan Mach, La Puente, CA (US); Hung Dan Chan Mach, Diamond Bar, CA (US)

(73) Assignee: Southern California Hydraulic Engineering, Inc., Brea, CA (US)

( * ) Notice: Subject to any disclaimer, the term of this patent is extended or adjusted under 35 U.S.C. 154(b) by 571 days.

(21) Appl. No.: 10/701,031

(22) Filed: Nov. 3, 2003

(65) Prior Publication Data

US 2004/0096343 A1 May 20, 2004

Related U.S. Application Data

(63) Continuation of application No. 09/954,828, filed on Sep. 18, 2001, now Pat. No. 6,676,386.

(51) Int. Cl.
*F04B 17/00* (2006.01)

(52) U.S. Cl. ..... 417/402; 417/398; 91/228

(58) Field of Classification Search ..... 417/398, 417/401, 402; 91/228; 92/110, 113, 153, 92/155

See application file for complete search history.

(56) References Cited

U.S. PATENT DOCUMENTS 1,550,933 A 8/1925 Tripplehorn
3,272,081 A 9/1966 Vedder et al.
3,587,405 A 6/1971 Holmes
4,042,311 A 8/1977 Yonezawa
5,173,036 A 12/1992 Fladby
5,380,428 A * 1/1995 Solomon ..... 210/136
5,478,217 A 12/1995 Jones
6,129,526 A * 10/2000 Kelly ..... 417/403
6,409,482 B1 6/2002 Fon

OTHER PUBLICATIONS

Hydraulics International, Inc., Product Description, 2 pages, at least as early as Sep. 17, 2001.

* cited by examiner

*Primary Examiner*—Charles G. Freay
(74) *Attorney, Agent, or Firm*—Robert D. Buyan; Stout, Uxa, Buyan & Mullins, LLP

(57) ABSTRACT

An oilless air motor assembly and method useable for driving hydraulic pumps and the like. The air motor assembly comprises a slide valve that moved back and forth relative to a valve sleeve situated about the slide valve. A low friction or lubricious dry seal member is disposed between the slide valve and the valve sleeve, thereby eliminating the need for added oil or lubricant and additionally avoiding the need for precise machining and matching (e.g., honing and lapping) of the slide valve and valve sleeve. Also provided is a kit for converting a previously manufactured air motor assembly that requires oil or added lubricant to an oilless air motor assembly. Such kit comprises the slide valve, valve sleeve and dry seal member as well as other optional parts associated with those elements.

10 Claims, 7 Drawing Sheets

14
15
13
39
38
16
32
17
34
36
35
18
31
42
19
30
102
5
28
100
9
41
37
104
11
40
26
29
27
47
105
22
33
106
7
58
56
57
10
21
23
25
20
24
48
49
59
50
51
43
45
46
44
12
52
55
63
61
53
64
62
60
54

OILLESS AIR MOTOR ASSEMBLY FOR HYDRAULIC PUMPS

This is a continuation of application Ser. No. 09/954,828 filed on Sep. 18, 2001 now U.S. Pat. No. 6,676,386.

FIELD OF THE INVENTION

The present invention relates generally to hydraulic pumps and more particularly to a hydraulic pump that may be operated without the need for added lubrication or atomized oil in the air source.

BACKGROUND OF THE INVENTION

The prior art has included a number of rotating and reciprocating air motors useable to drive hydraulic pumps and the like. One such air motor is described in U.S. Pat. No. 3,272,081(Vedder, et al.) entitled Air Motor, the entirety of which is expressly incorporated herein by reference.

One drawback associated with at least some of the reciprocating air motors of the prior art, including that described in U.S. Pat. No. 3,272,081, is that slide valve(s) within the air motor ride in metal to metal contact with valve sleeve(s) or other parts of the apparatus and continual lubrication must be dispensed into, such metal to metal interface to avoid excessive wear of the piston(s) and to maintain a reasonable service life for the air motor. Additionally, the slide valve(s) and sleeve(s) or other parts between which the metal to metal fit is required must be precisely machined for a high tolerance fit and are typically required to be made of hard. machinable metal such as stainless steel. The application of lubricant upon the engaged metal surfaces was typically accomplished by atomizing oil in the air that is used within the air motor such that the atomized oil will deposit on the piston(s) and other parts of the air motor apparatus that frictionally interface with the piston(s). However, when the air exhausts from the air motor, some amount of atomized oil typically remains in the exhausted air and presents a health risk to workers who incur long term respiratory exposure to the said atomized oil that is exhausted by the air motor. Additionally, the use of atomized oil in the air can be laborious, cumbersome and adds expense to the operation in which it is used.

In view of the foregoing, there exists a need in the art for the development of an oilless reciprocating air motor of the type described in U.S. Pat. No. 3,272,081 wherein self lubricating or lubricious materials are positioned between the slide valve(s) and valve sleeve(s) or other portions of the air motor that frictionally interface with the slide valve(s), thereby eliminating the need for precisely machined, high tolerance fits between such parts and also eliminating the need for the use of atomized oil, other added oil or grease or added lubricant during routine operation of the air motor.

SUMMARY OF THE INVENTION

The present invention comprises an oilless air motor that is useable in a variety of applications, including the driving of a reciprocating pump component such as the ram or piston of a hydraulic pump.

In accordance with this invention, there is provided an air motor comprising a body having a bore, an air cylinder that extends from said body and opens to said bore, a first manifold, a second manifold, a third manifold, an air inlet port that leads to the first manifold, an air exhaust port that leads to the second manifold, and at least one passageway that leads from the third manifold and opens into the upper end of the air cylinder, an air piston in said cylinder provided with a hollow stem operative in the body bore and having ports opening through the bottom thereof, a slide valve sleeve disposed in the bore about the air piston, slide valve sleeve being moveable between an upper position and a lower position, slide valve sleeve providing communication (i) between the air inlet and the body bore and between the air exhaust and the upper portion of the air cylinder via the passageway, when the valve sleeve is in one of said positions; and, (ii) between the air inlet and the upper end of the air cylinder via the passageway and between the body bore and the air exhaust, when the sleeve valve is in the other of said positions; a pilot valve disposed within the valve sleeve, the pilot valve having an axial bore with a piston at one end, said pilot valve being shiftable by air pressure from the inlet entering the body bore, as controlled by the valve sleeve; a first check valve carried by the pilot valve to allow air to be received through the ports of the air piston; a second check valve carried by the pilot valve to allow air to pass from beneath the air piston into the body bore; and, a dry seal member disposed between the valve sleeve and a part of the air motor adjacent the valve sleeve to allow the valve sleeve to move back and forth without the need for oil or other lubricant between the valve sleeve and the part of the air motor adjacent the valve sleeve. In some embodiments, a slide valve will be positioned about the air piston and the dry seal will be disposed between the slide valve and the valve sleeve.

Further in accordance with the invention, the dry seal member may be formed at least partially of a lubricious material, such as a lubricious polymer or a graphite-containing or graphite-impregnated polymer.

Still further in accordance with the invention, a retaining apparatus such as a retaining ring that snap fits into an annular groove on the slide valve or other portion of the air motor adjacent to the valve sleeve to limit or prevent unwanted slippage or movement of the dry seal as the air motor operates.

Still further in accordance with the invention, there is provided a kit for replacing parts of an existing air motor that requires atomized oil or other added lubrication to eliminate the need for the continued use of atomized oil in the air or other added lubrication. Such kit may comprise a replacement air piston assembly comprising a slide valve, a valve sleeve that substantially surrounds the slide valve and a dry seal formed of lubricious material and disposed between the slide valve and the valve sleeve to prevent direct friction between the slide valve and the valve sleeve.

Further aspects and elements of this invention will become apparent to those of skill in the art upon reading the detailed description that appears herebelow in reference to the accompanying drawings.

DETAILED DESCRIPTION OF PREFERRED EMBODIMENTS

Figure 1A:
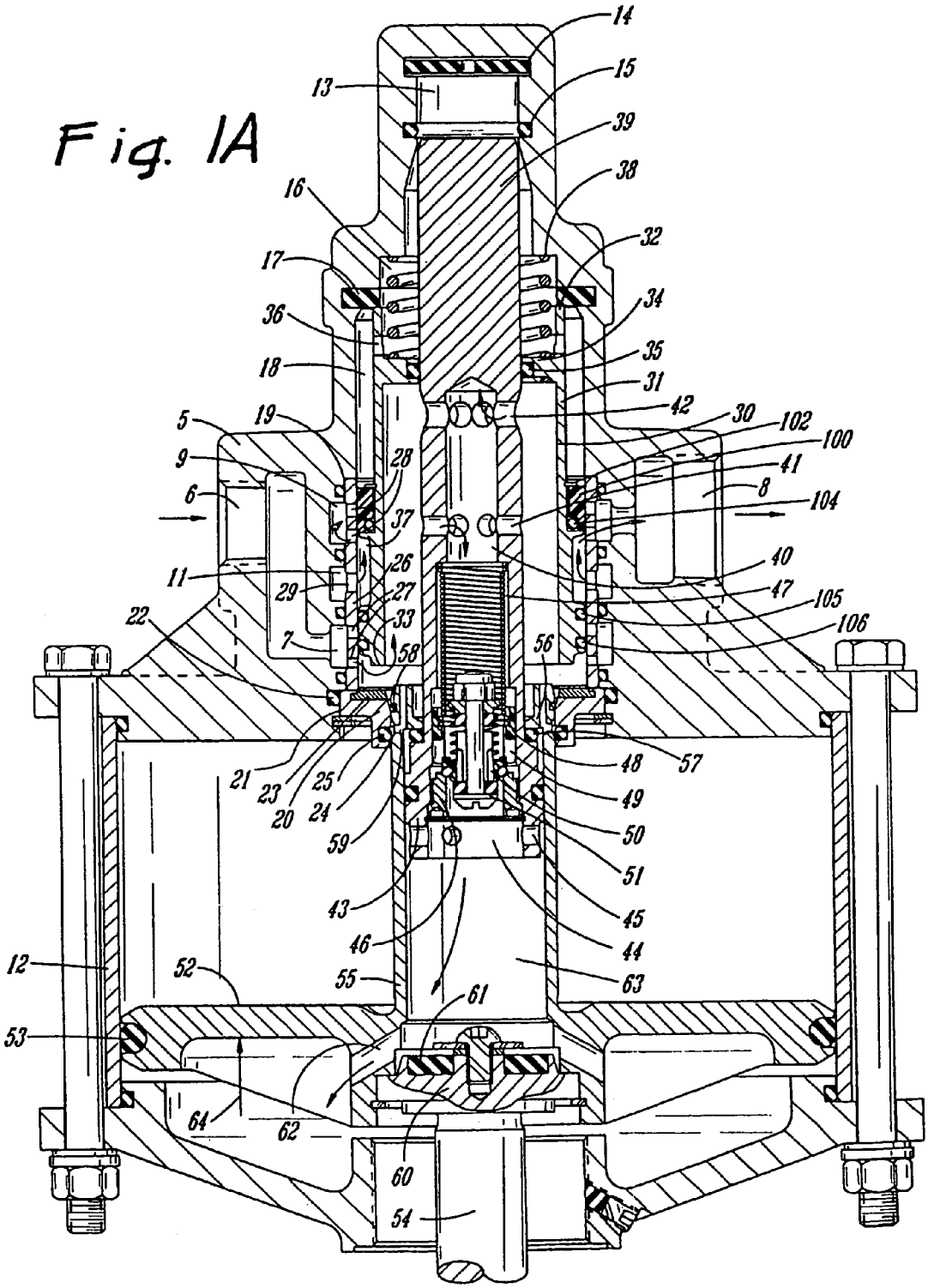
FIG. 1*a* is a longitudinal sectional view of an oilless air motor apparatus according to the present invention, taken through a vertical plane with the air piston in the down position.

The following detailed description, and the drawings to which it refers, are provided for the purpose of describing and illustrating certain examples or embodiments of the invention only and are not intended to exhaustively describe or show all possible embodiments or examples of the invention.

An example of an oilless hydraulic pump apparatus of the present invention is shown in FIGS. 1–8, as follows:

A. An Oilless Air Motor Apparatus

The embodiment of the air motor shown in FIGS. 1–8 comprises an air motor useable to cause a member, such as a piston or cam of a hydraulic pump, to reciprocate. This embodiment of the air motor comprises a body 5 that has an air inlet port 6 that leads to a first manifold 7, an air exhaust port 8 that leads to a second manifold 9, and one or more air passages 10 that lead from a third manifold 11 and open into the upper end of an air cylinder 12 extending from the lower end of the body 5. Said body 5 has a small bore 13 in its upper end with a compressible bumper 14 at the upper end of the bore, an O-ring seal 15 being provided adjacent the lower end of said bore. A counterbore 16, provided with a bumper 17, extends from the lower end of the small bore 13.

A larger counterbore extension 18 of the counterbore 16 has the bumper 17 at its upper end, a still larger counterbore 19 extending from the counterbore 18, the three manifolds 7, 9 and 11 opening on the bore 19. A bearing 20 is fitted into a counterbore extension 21 at the lower end of the body 5, a sealing O-ring 22 in the body sealing the fit. A bumper 23 is provided in the upper face of said bearing 20 which has an inner bore 24 in which an O-ring 25 is fitted.

A liner 26 is fitted into the counterbore 19 between the bearing 20 and the shoulder that is formed between the latter counterbore and the bore 18 from which it extends. Said liner is provided with lower longitudinally spaced ports 27 that connect the manifold 7 with the inner bore of said liner, with upper longitudinally spaced ports 28 that connect the manifold 11 with said liner bore, and with intermediate ports 29 that connect the manifold 11 with said liner bore.

Figure 1B:
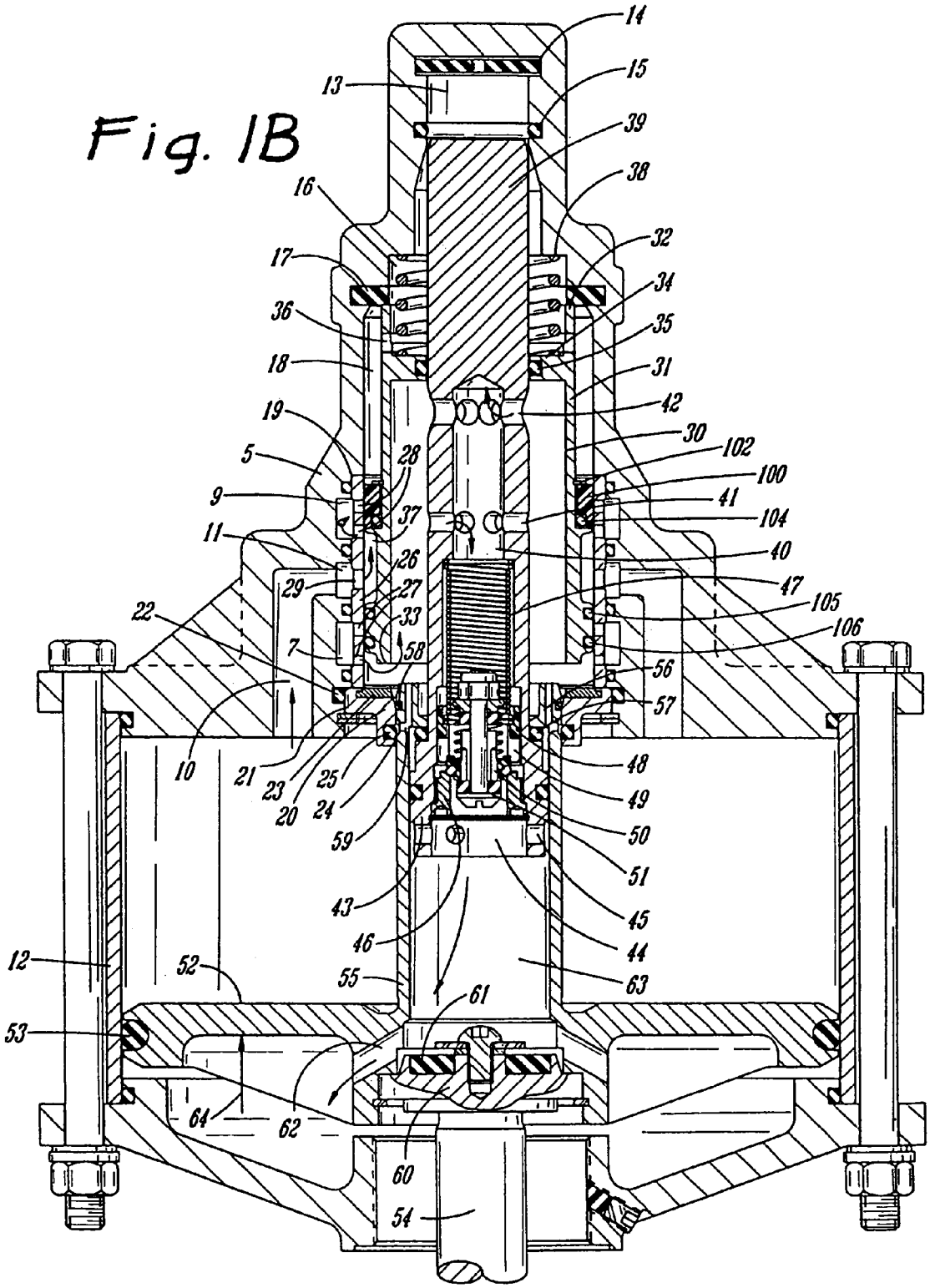
FIG. 1*b* is another longitudinal sectional view of the oilless air motor apparatus of FIG. 1*a* taken through a plane that is rotated 90 degrees from the plane through which the section of FIG. 1*a* was taken.
Figure 1C:
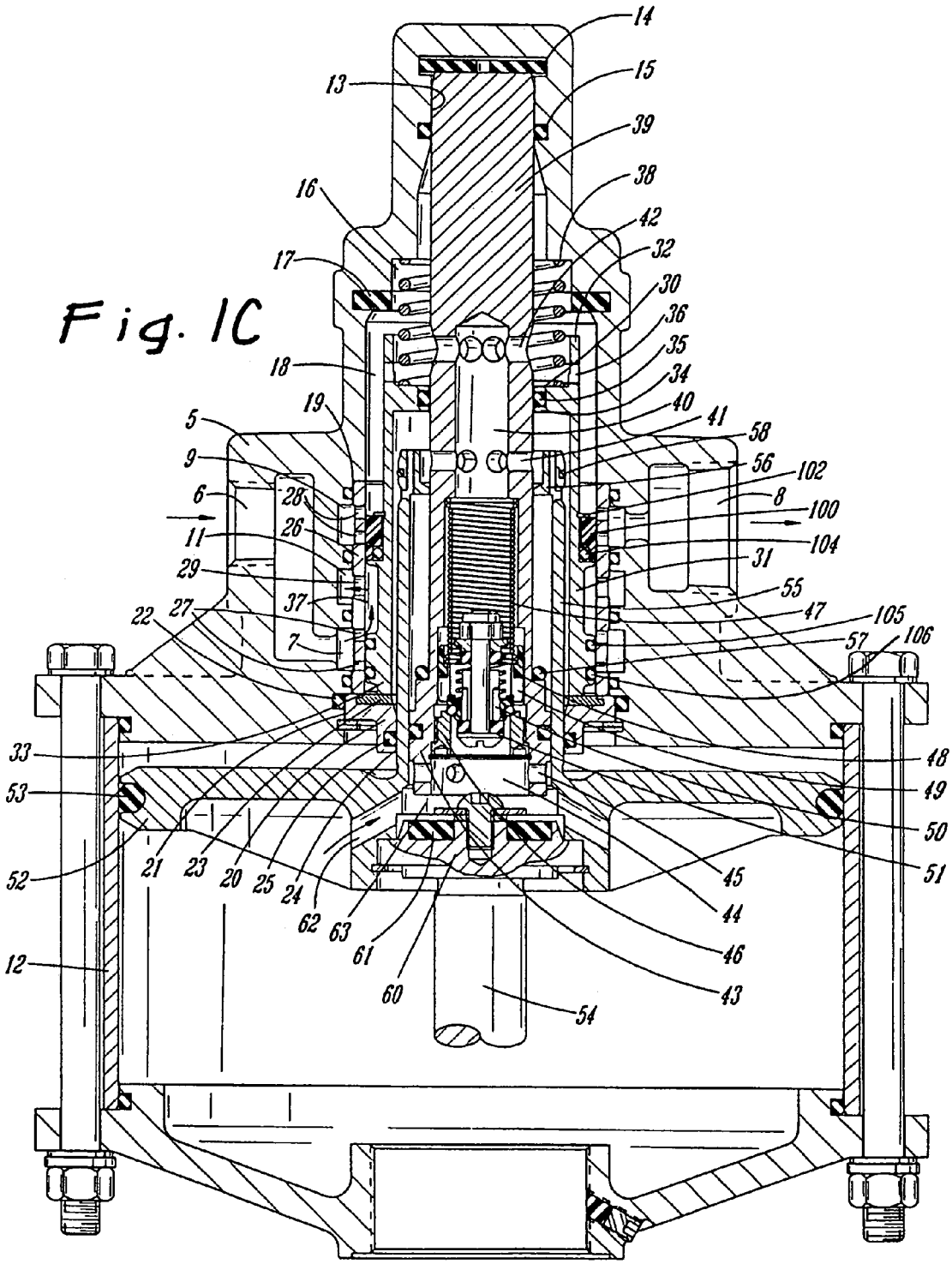
FIG. 1*c* is a longitudinal sectional view of an oilless air motor apparatus according to the present invention, taken through a vertical plane with the air piston in the up position.

A four-way slide valve 30, in the form of a tubular portion 31, has a sliding fit in the bore of the liner or valve sleeve 26, with its upper end 32 engaged with the bumper 17 when the valve 30 is in raised position, as in FIG. 1A, and with its lower end 33 engaged with the bumper 23 in the upper face of the bearing 20, when said head is in lowered position, as in FIG. 1C. An inner flange wall 34, provided with an O-ring 35 in the bore of said wall extends from the tubular portion 31 of the head 30. Ports 36 are provided in the part of the portion 31 that extends above the flange wall 34. An annular external groove 37 has operative association with the ports 27 and 28 to communicate the same, according to the raised and lowered positions of the head, with the ports 29. It will be noted that the bore 30 and the bore of the flange wall 34 are the same diameter. A spring 38 between said flange wall 34 and an abutment wall formed by bores 13 and 16, biases the valve 30 to its lower position.

In this embodiment a ring shaped dry seal 100 extends around the outer surface of the slide valve 30 and formed a seal between the slide valve 30 and the valve sleeve 26. A retaining ring 102 snap fits within a groove formed about the slide valve 30 and the upper end of the dry seal 100 abuts against the retaining ring 102. In this manner the retaining ring 102 prevents the dry seal 100 from sliding or migrating upwardly on the body of the slide valve 30 as the air motor operates. The dry seal is preferably formed of wear-resistant, smooth and/or lubricious material, such as a polymer or graphite-containing, graphite-filled or graphite-impregnated polymer. In the embodiment shown, the dry seal 100 is formed of 25% carbon/graphite filled polytetrafluoroethylene (PTFE). An O-ring seating notch may be formed about the lower end of the inner surface of the dry seal 100 to receive an O-ring 104, as shown. This O-ring 104 may be any suitable type of O-ring, such as a Buna O-ring formed of material having a Shore hardness of 70. The function of this O-ring 104 is to exert outwardly directed radial pressure against the inner surface the dry seal 100, thereby causing the outer surface of the dry seal 100 to seal against the valve sleeve 26. This dry seal assembly which comprises the dry seal 100, retaining ring 102 and O-ring 104, serves to provide a low friction or lubricious interface between the slide valve 30 and valve sleeve 26, thereby eliminating the need for the use of atomized oil in the air received within the air motor or the application of oil, grease or other added lubricant. Also, the interposition of this dry seal 100 between the slide valve 30 and sleeve 26 eliminates the need for a high tolerance, precisely machined and matched (e.g. honed and lapped) fit between the outer surface of the slide valve 30 and inner surface of the sleeve 26, as had been required in prior art air motors of this type. In view of this, the slide valve 30 need not necessarily be formed of stainless steel, but rather may be formed of aluminum or other material. In the particular embodiment shown, the valve sleeve 26 is formed of stainless steel and has an inner diameter that allows a gap or space between the inner surface of the sleeve 26 and the outer surface of the slide valve 30, the width of such gap or space being the same as the width of the dry seal 100 such that firm sealing contact will be established between the slide valve 30, seal 100 and valve sleeve 26.

Figure 1D:
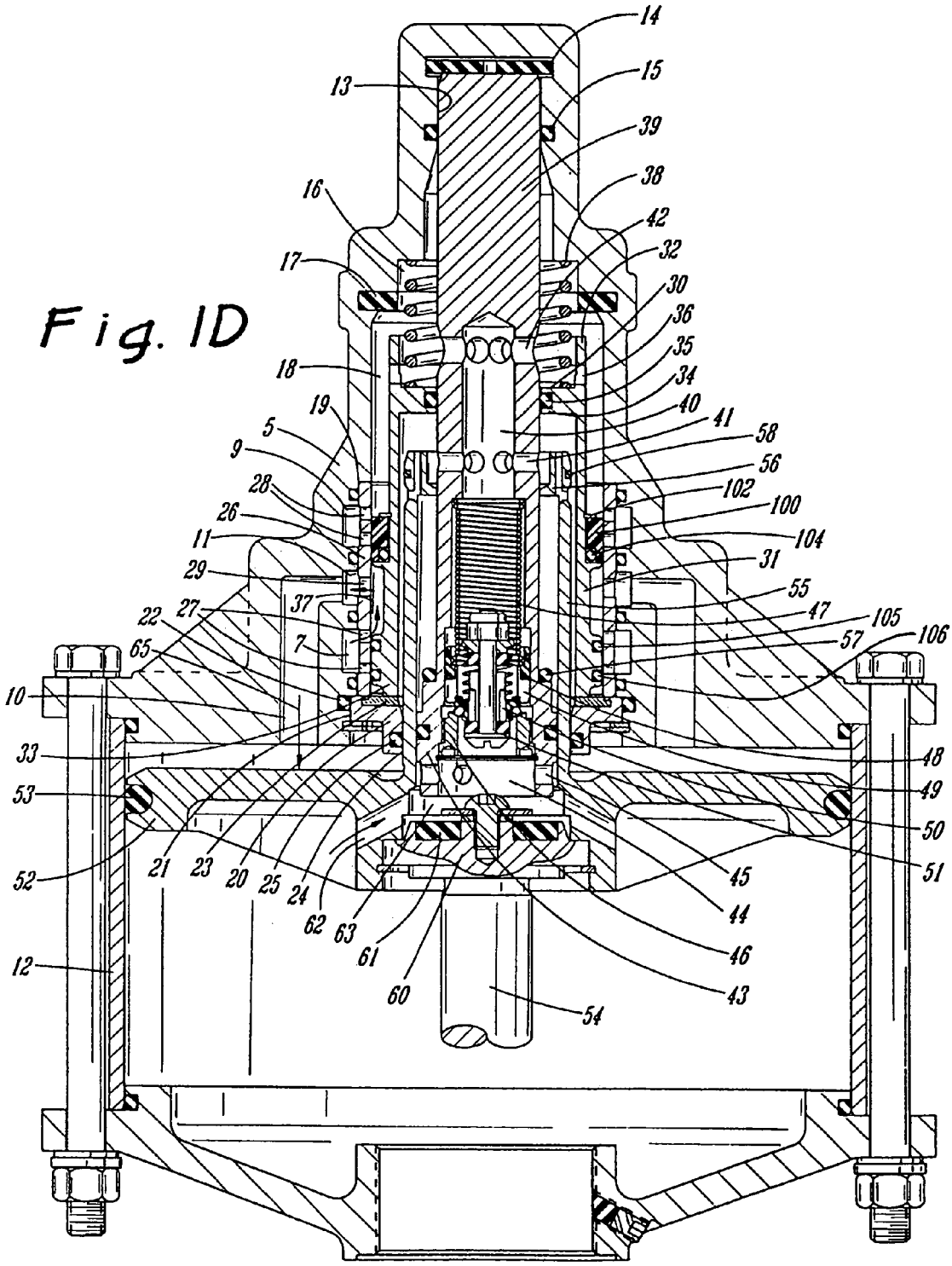
FIG. 1*d* is another longitudinal sectional view of the oilless air motor apparatus of FIG. 1*c* taken through a plane that is rotated 90 degrees from the plane through which the section of FIG. 1*c* was taken.
Figure 3:
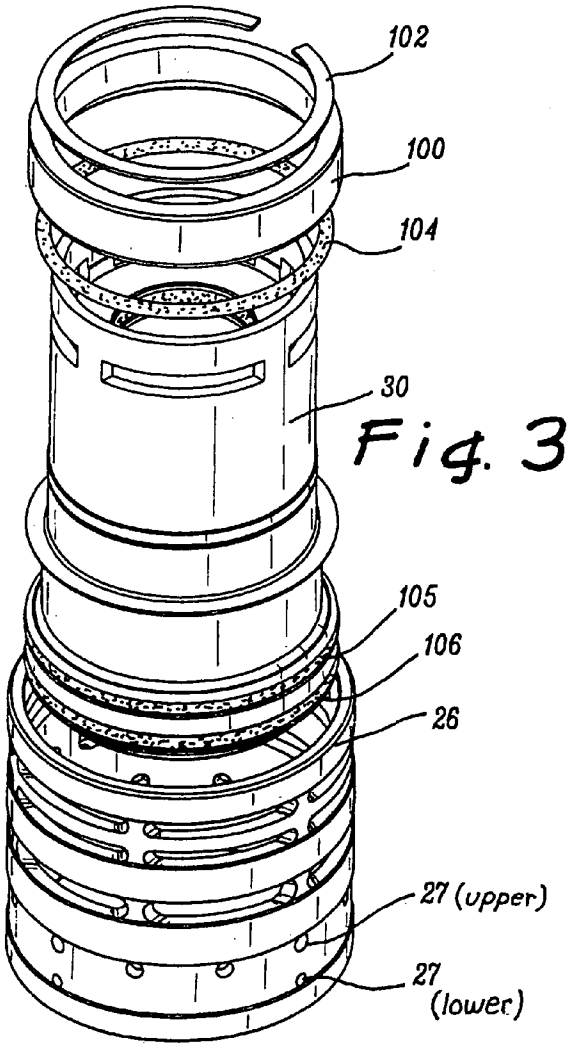
FIG. 3 is an exploded perspective view of the air piston actuating valve assembly of FIG. 2.
Figure 2:
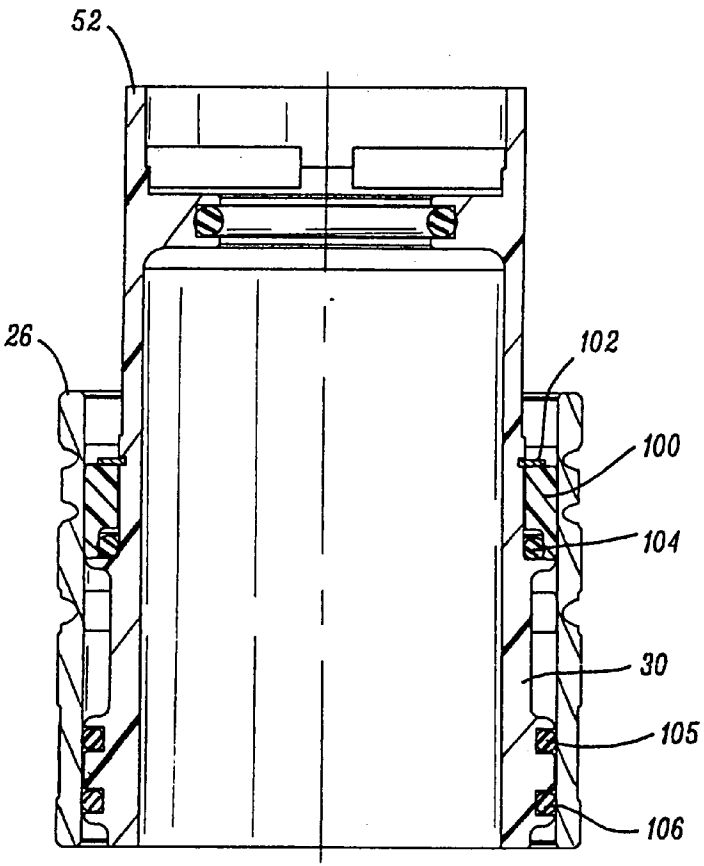
FIG. 2 is an enlarged sectional view of the air piston actuating valve assembly of an oilless air motor apparatus of the present invention.
Figure 4:
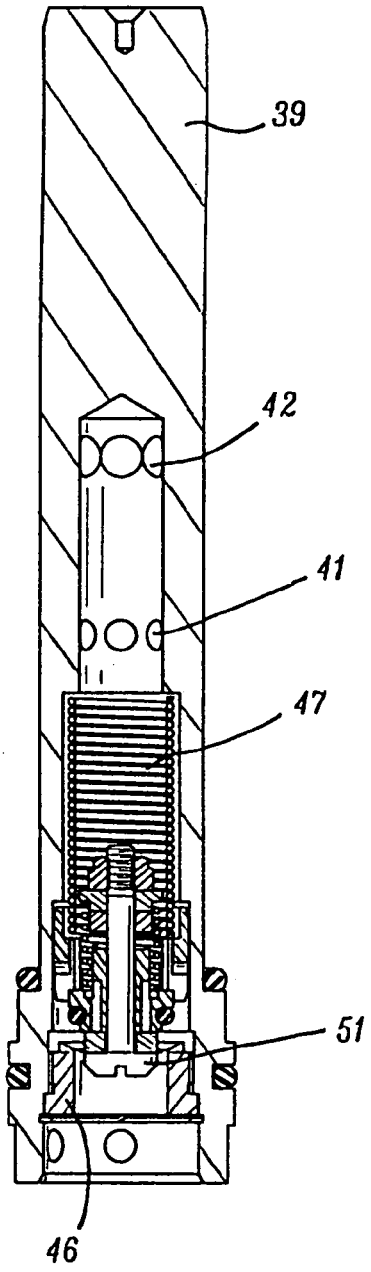
FIG. 4 is a longitudinal sectional view of the pilot valve assembly of an oilless air motor apparatus of the present invention.
Figure 5:
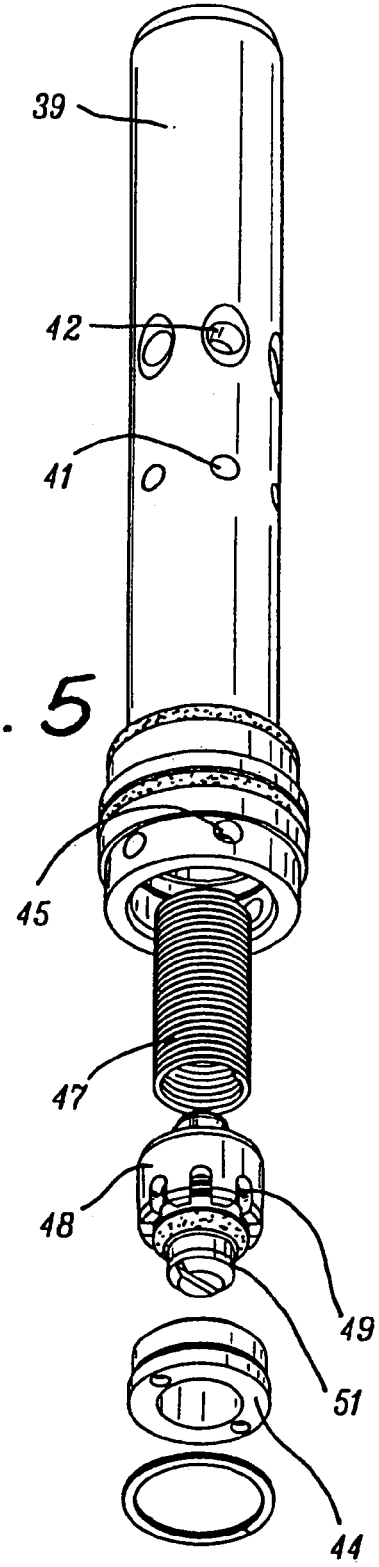
FIG. 5 is an exploded perspective view of the pilot valve assembly of FIG. 4.
Figure 8:
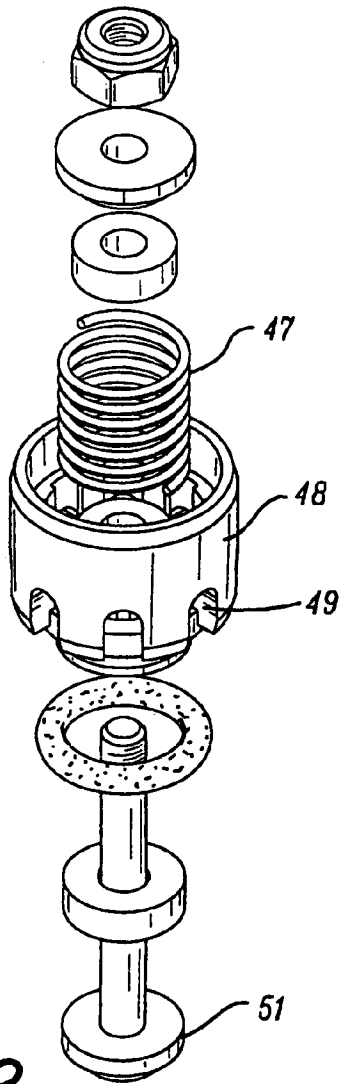
FIG. 8 is an exploded perspective view of the air check assembly of FIG. 7.
Figure 7:
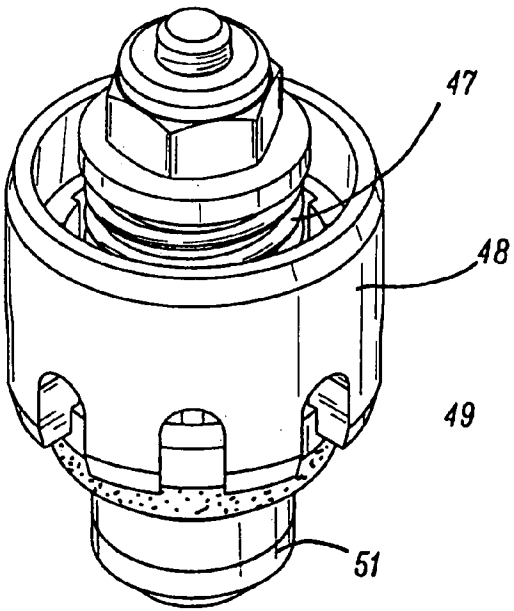
FIG. 7 is a perspective view of the air check assembly of FIG. 6.
Figure 6:
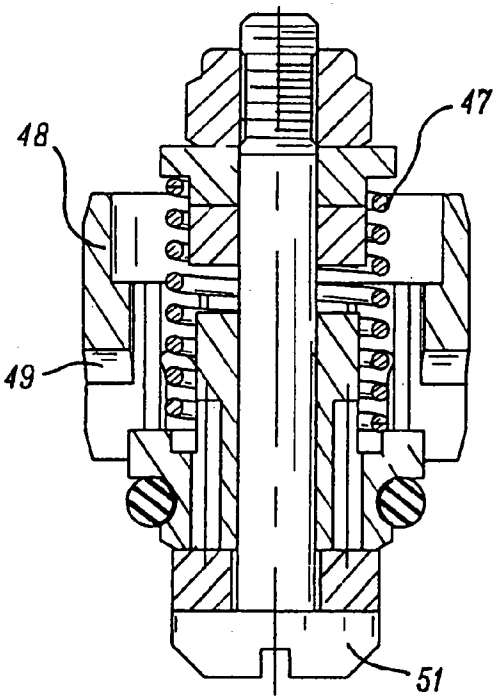
FIG. 6 is a longitudinal sectional view of the air check assembly of an oilless air motor apparatus of the present invention.

O-rings 105 and 106 facilitate the desired function of the piston activating valve. When the slide valve 30 is in its down position as shown in FIGS. 1*c* and 1*d*, upper O-ring 105 is positioned to allow air to flow from manifold 7, through upper ports 27 and lower O-ring 106 is positioned to seal the lower ports 27. This causes air to pass through manifold 11 into the air cylinder above air piston 52. When the slide valve 30 is in its up position as shown in FIGS. 1*a* and 1*b*, the upper O-ring 105 is positioned to seal and prevent flow through upper ports 27 and the lower O-ring 106 is positioned to allow air to flow from manifold 7 through lower ports 27. This causes the air to enter the tubular portion or bore 31, overcoming the force created by the spring 38 and thereby causing the slide valve 30 to move to its up position with the air passing through ports 41 and 42, opening the air check and accumulating below the air piston 52 as described herebelow.

A pilot valve 39 has a sliding fit in the mentioned bore 31 and the bore of the flange wall 34, the same having an axial bore 40 that is closed at the top and is provided with two sets of radial ports 41 and 42 that pass air from within the four-way valve 30 to the bore 40. The lower end of pilot valve 39 comprises a piston 43, a skirt 44 below said piston being provided with radial ports 45.

The valve 39, in its bore 40, fixedly mounts a valve seat 46 against which a spring 47 biases a valve body 48 which has angular ports 49 in its wall as well as a set of longitudinal passages 50. Said latter ports and passages are open to the bore 40 of the valve 39, the former being closed when the body 48 is seated on seat 46, and the latter being closed by a check valve 51 which opens only in a downward direction under pressure of air in the valve passage 40.

An air piston 52 has sliding operative engagement in the cylinder 12 which is of larger size than the largest bore in the body 5, the same being fitted with an O-ring 53 to seat against the cylinder. Said piston carries an axially disposed ram 54 of considerably smaller size than the piston, said ram, due to its smaller size, having a power or pressure factor on its operative end that is the same as the total air pressure on either side of the piston.

The air piston 52 is provided with an upwardly directed stem 55 that comprises a tubular extension that has sliding fit in the bore 24 of bearing 20 and an inner surface that constitutes a cylinder for the piston 43. A ported inwardly directed flange 56 at the upper end of said stem 55 over stands the piston 43, an O-ring 57 forming a bumper between said flange and said piston. An O-ring 58 on the upper end of said stem 55 is arranged to seal against the bore 24 of the bearing 20 when the piston 52 is at the end of its down stroke. Ports 59 open on a relieved portion of the outer surface of the stem 55.

The ram 54 is provided at its upper end with an enlargement 60 that is connected to a lower extension of the air piston 52. The upper portion of said enlargement is provided with a bumper pad 61 which is adapted to be abutted by the lower skirt end 44 of the valve 39. Above said enlargement, the air piston is provided with passages 62 that open from the inner cylinder bore 63 in which the piston 43 of said valve 39 operates and into which the radial ports 45 open.

B. Operation of the Air Motor Apparatus

At the end of the down stroke of the ram 54, the four-way valve 30 is in the raised position of FIG. 1A. Compressed air at inlet 6 will pass through the lower of the ports 27 of liner 26 and enter the bore of the valve 30. This air, through ports 41 and 42, enters the bore 40 of the pilot valve 39, creating an upward force against the blind end of the bore 40 that raises through ports 50 in the valve body 48 and opens the check valve 51, said air then entering the bore 63 and passing through passages 62 to create a force in the direction of arrow 64 between the bottom of the cylinder 12 and the under surface of the air piston 52.

As a result of such air flow, the valve 39 will move upwardly while the air piston 52 is moving through its up stroke. During this up stroke of the air piston, the same displaces air in the upper end of the cylinder; this air, by way passages 10, port 29, groove 37, and the lower ports 28, exhausts through the port 8.

It will be noted that the valve 39 cannot move up faster than the piston 52 due to the interengagement of the piston 43 of said valve and the flange 56. This insures that the valve 39 cannot prematurely reach its four-way valve-reversing position. This interengagement, however, allows the piston 52 to make its full upward recovery movement to the position of FIG. 1C before the valve reaches its maximum raised position against the bumper 14, as shown. In practice, said valve 39 need not raise to such maximum position, but only enough so that the ports 42 thereof pass the O-ring 35 of the distributor head 30 so that the air pressure in the bore 40 can enter the counterbore 16 of the body 5. Since, by the time the ports 42 pass O-ring 35, the upper end of the valve 39 has entered the bore 13 and is sealed by O-ring 15, the pressures in said counterbore 16 and in the inside of the air distributor 30 below the flange 34, are equalized. As a consequence, the spring 38 becomes effective to move the four-way valve downward to the position of FIG. 1C.

In this position, compressed air at inlet 6 will pass through the upper of the ports 27, groove 37, and passages 10, and enters the upper end of the cylinder 12 to produce a force on the piston 52, according to arrow 65, to move the latter downward in its power stroke. This down stroke of the piston 52 causes displacement of air in the cylinder 12 below said piston, this air passing through ports 62 into bore 63, unseating the valve body 48 and passing through angular ports 49 into the bore 40 of the valve 39. This air passes through ports 41 when the same become uncovered due to the downward movement of the tubular extension 55 and its flange 56 of the piston 52, into the interior bore of the four-way valve 30. At the same time, air from bore 40 will pass through ports 42 into counterbores 16 and 18 and will exhaust through the upper of ports 28 through the exhaust port 8. Upon such exhaust taking place, the pressure within the four-way valve 30 will become effective to shift the latter upwardly to the position of FIG. 1A, terminating the down or power stroke and completing the cycle of operation.

Due to the sliding fit among the valves 30 and 31, the liner or sleeve 26, the stem 55 and the piston 52 in the cylinder 12, the fit between the bearing 20 and the stem 55 is quite loose. When the annular clearance at the point is added to the small ports 59 and the ports in the flange 56, the air-passing area between the interior of the four-way valve and the upper port of the air cylinder is large.

Under low air pressure of between five and twenty pounds, the pressure in the interior of valve 30 leaks to the air cylinder 12 too rapidly for the air inlet through the lower of the ports 27, as the same is being uncovered, to complete the full up movement of the valve 30. The latter may "hang" in an intermediate position resulting in a constant bypass of air around the bearing 20. The O-ring 58 is provided to prevent such bypass of air, since the same closes the annular clearance between said bearing and the piston stem 55, leaving only the small ports 59 and those in the flange 56 to exhaust the interior of the four-way valve. Hence, the four-way valve will shift fully to its maximum opening of the lower of the ports 27.

It is this feature that enables the present air motor to operate with compressed air as low as five psi and as high as one hundred psi, or more.

While the foregoing has illustrated and described what is now contemplated to be the best mode of carrying out the invention, the construction is, of course, subject to modification without departing from the spirit and scope of the invention. Therefore, it is not desired to restrict the invention to the particular form of construction illustrated and described, but to cover all modifications that may fall within the scope of the appended claims.

Although exemplary embodiments of the invention have been shown and described, many changes, modifications and substitutions may be made by those having ordinary skill in the art without necessarily departing from the spirit and scope of this invention. Specifically, elements or attributes described in connection with one embodiment may also be used in connection with another embodiment provided that the inclusion or use of such element or attribute would not render the embodiment in which it is incorporated unuseable or otherwise undesirable for an intended application. Accordingly, all such additions, deletions, modifications and variations to the above-described embodiments are to be included within the scope of the following claims.

What is claimed is:

1. An air piston actuating valve assembly kit for converting an oiled air motor apparatus that requires added lubricant to a dry air motor apparatus that does not require lubricant; wherein the oiled air motor apparatus comprises a body having a bore; an air cylinder that extends from said body and opens to said bore; a first manifold, a second manifold, a third manifold, an air inlet port that leads to the first manifold, an air exhaust port that leads to the second manifold, and at least one passageway that leads from the third manifold and opens into the upper end of the air cylinder, an air piston assembly comprising i) an air piston in said cylinder provided with a hollow stem operative in the body bore and having ports opening through the bottom thereof and ii) a slide valve and valve sleeve disposed in the bore about the air piston, said slide valve sleeve providing communication between the air inlet and the body bore and between the air exhaust and the upper portion of the air cylinder via the passageway when said slide valve is in one of said positions and between the air inlet and the upper end of the air cylinder via the passageway and between the body bore and the air exhaust when the slide valve is in the other of said positions; said air motor apparatus further comprising a pilot valve disposed within the slide valve, the pilot valve having an axial bore with a piston at one end, said pilot valve being shiftable by air pressure from the inlet entering the body bore, as controlled by the slide valve; said oiled air motor apparatus further comprising a first check valve carried by the pilot valve to allow air to be receive through the port of the air piston; a second check valve carried by the pilot valve to allow air to pass from beneath the air piston into the body bore, wherein the slide valve slides in metal to metal contact with the sleeve and lubrication is required between the slide valve and the sleeve when the slide valve slides in metal to metal contact with the sleeve and lubrication is required between the slide valve and the sleeve during normal operation of the air motor, and wherein the kit comprises:

at least a replacement air piston actuating valve assembly comprising i) a replacement valve sleeve disposable in the bore about the air piston, said replacement slide valve being moveable between an upper position and a lower position, said replacement slide valve providing communication between the air inlet and the body bore and between the air exhaust and the upper portion of the air cylinder via the passageway when the slide valve is in one of said positions and between the air inlet and the upper end of the air cylinder via the passageway and between the body bore and the air exhaust when the sleeve valve is in the other said positions and ii) a dry seal member disposable between the replacement slide valve and the replacement valve sleeve, said dry seal member being formed of lubricious material that eliminates the need for added lubricant during routine operation of the air motor apparatus.

2. A kit according to claim 1 further comprising a dry seal retaining apparatus which prevents the seal member from migrating upwardly on the replacement piston.

3. A kit according to claim 2 wherein the dry seal retaining apparatus comprises a retaining ring seating groove formed in the air piston and a dry seal retaining ring, the retaining ring being positioned above the dry seal member and seated within the retaining ring sealing groove such that the dry seal member and retaining ring are prevented from migrating upwardly above the retaining ring seating groove.

4. A kit according to claim 1 wherein the dry seal member has an inner surface and an annular o-ring seating grove formed in said inner surface, and wherein the kit further comprises an o-ring that is sized to be seated in the o-ring seating groove and captured between the inner surface of the dry seal member and slide valve.

5. A kit according to claim 1 wherein the dry seal member has an inner surface and an annular o-ring seating grove formed in said inner surface, and wherein the kit further comprises:

a dry seal retaining apparatus which prevents the seal member from migrating upwardly on the replacement piston; and, an o-ring sized to be seated in the o-ring seating groove and captured between the inner surface of the dry seal member and slide valve.

6. A kit according to claim 1 wherein the dry seal member is formed at feast partially of lubricious material that comprises a polymer.

7. A kit according to claim 6 wherein the lubricious material comprises polytetrofluoroethylene.

8. A kit according to claim 6 wherein the lubricious material comprises a graphite filled polymer.

9. A kit according to claim 8 wherein the graphite filled polymer comprises graphite filled polytetrofluorothylene.

10. A kit according to claim 9 wherein the graphite filled polytetrafluoroethylene contains approximately 25% by weight graphite.

* * * * *